United States Patent [19]

Schultz

[11] Patent Number: 4,690,339

[45] Date of Patent: Sep. 1, 1987

[54] HAMMER MILL

[76] Inventor: Richard Schultz, Morschwil SG, CH-9402 Morschwil, Switzerland

[21] Appl. No.: 912,249

[22] PCT Filed: Dec. 30, 1985

[86] PCT No.: PCT/CH85/00183

§ 371 Date: Aug. 29, 1985

§ 102(e) Date: Aug. 29, 1985

[87] PCT Pub. No.: WO86/03990

PCT Pub. Date: Jul. 17, 1986

[30] Foreign Application Priority Data

Jan. 2, 1985 [DE] Fed. Rep. of Germany ..... 3500032
Dec. 23, 1985 [CH] Switzerland ..... 05521/85

[51] Int. Cl.[4] ..... B02C 13/286

[52] U.S. Cl. ..... 241/73; 241/101 D; 241/186 A; 241/186.1; 241/189 R

[58] Field of Search ..... 241/69, 189 R, 101 D, 241/186 A, 186.1, 186.4, 138, 186 R, 188 R, 73, 74

[56] References Cited

U.S. PATENT DOCUMENTS 1,711,464 4/1929 Ruprecht et al. ..... 241/186.1
2,155,697 4/1939 Young .
4,273,294 6/1981 Hollely et al. ..... 241/189 X

FOREIGN PATENT DOCUMENTS 1072063 12/1959 Fed. Rep. of Germany ..... 241/73
2423669 11/1975 Fed. Rep. of Germany ... 241/188 R
1041622 10/1953 France .
171102 4/1960 Sweden ..... 241/73
462588 3/1937 United Kingdom .
1072891 2/1984 U.S.S.R. ..... 241/188 R

*Primary Examiner*—Mark Rosenbaum
*Attorney, Agent, or Firm*—Frost & Jacobs

[57] ABSTRACT

The hammer mill comprises a horizontally arranged grinding chamber (1), at the periphery of which several supply ducts (4) with an inlet (*7a*) for the coarse material to undergo size reduction are distributed, each supply duct (4) being associated with a corresponding adjacent discharge duct (5) with an outlet (*7b*) for the product of reduced size. The inlets (*7a*) and the outlets (*7b*) are alternately arranged and uniformly distributed over the periphery of the grinding chamber and the grinding chamber (1) is thereby subdivided peripherally into a corresponding number of mill segments which are each defined by a supply duct (4) with an inlet (*7a*) and an associated discharge duct (5) with an outlet (*7b*). A special feed proportioning apparatus is provided with coaxial cells (21, 22) and several proportioning screws (23) so as to continuously provide the supply ducts (4) of the hammer mill with various coarse materials from corresponding cells (21, 22). The hammer mill and the feed proportioning apparatus are both suitable for various loose materials and size reduction operations and offer particular advantages for the preparation of mixed fodder.

7 Claims, 5 Drawing Figures

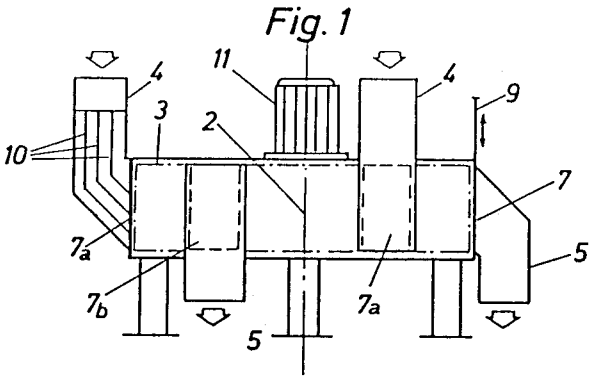
Fig. 1
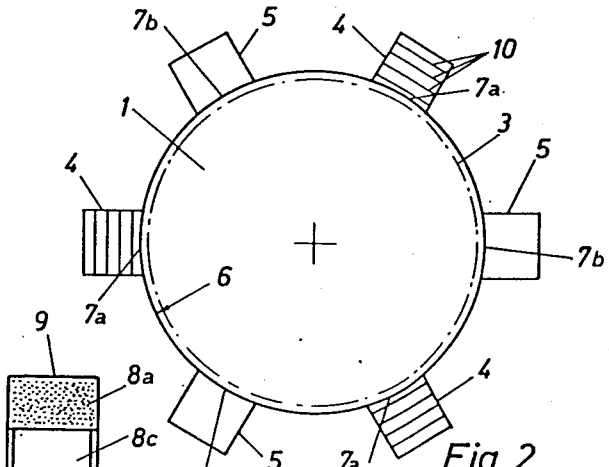
Fig. 2
Fig. 3
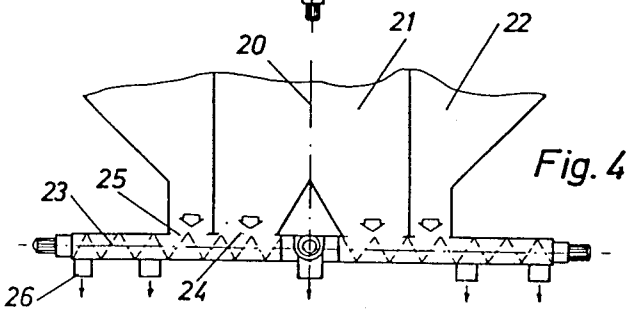
Fig. 4
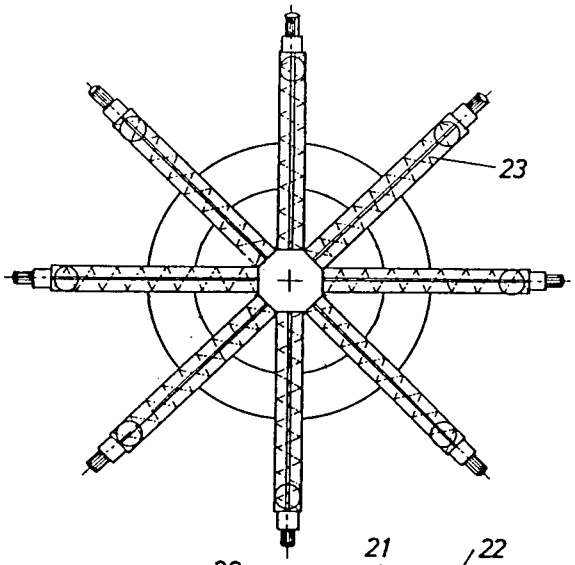
Fig. 5

HAMMER MILL

FIELD OF THE INVENTION

The invention relates to a hammer mill with a grinding chamber, a rotor with hammers or beaters for size reduction of coarse material and an apparatus for feeding coarse material and discharging the product of reduced size.

STATE OF THE ART

In hammer mills of said type, the rotor generally turns in the grinding chamber about a horizontally arranged axis while the feed is effected in the top zone of the grinding chamber. A breaker plate in the form of a screen sleeve is generally provided at least in the lower part of the grinding chamber, through which the product of reduced size comes into a collecting compartment enclosing the grinding chamber and/or the screen sleeve and is discharged therefrom. Such hammer mills have high energy requirements as the product of reduced size can only pass with difficulty through the screen sleeve, is needlessly carried along and passes repeatedly through the grinding chamber.

SUMMARY OF THE INVENTION

The object of the invention is to provide a hammer mill of said type which allows size reduction with significant energy savings and a high efficiency.

This object is achieved according to the invention in a hammer mill of said type by the features set forth in the claims.

The invention is based on the insight that in a hammer mill the material fed into the grinding chamber already undergoes size reduction after a very short grinding path. When the feed material is first struck by the hammers, a substantial size reduction mostly takes place, whereafter the product of reduced size circulates needlessly with the rotor until it can go out through the screen sleeve.

The hammer mill according to the invention is advantageously provided with several inlets and outlets distributed uniformly over the periphery of the grinding chamber so as to be able to ensure uniform loading of the rotor, also when the direction of rotation of the rotor is reversed to provide for utilization of the hammers or beaters on both sides.

The supply ducts are preferably arranged so that the coarse material is supplied to the grinding chamber in different horizontal planes, so as to thereby further allow full uswe of the rotor height.

Thanks to the horizontal arrangement of the grinding chamber with a vertical rotor axis according to the invention, it is possible to arrange a great number of supply and discharge ducts distributed in a particularly simple and advantageous manner over the periphery of the grinding chamber, whereby the material supplied from above may be easily fed in radially. As each supply duct is associated with a discharge duct which is arranged at a relatively short distance behind this supply duct, the material fed in via each supply duct can, directly after undergoing size reduction on impingement of the hammers or beaters, be directly discharged from the grinding chamber as a product of reduced size via the discharge duct corresponding to the next outlet. The product of reduced size is thus no more carried along needlessly, as hitherto in the grinding chamber.

By the special arrangement according to the invention, the hammer mill is subdivided peripherally into a more or less great number of consecutively arranged mill segments, each defined by an inlet with the corresponding supply duct and by an outlet with the corresponding discharge duct arranged adjacent thereto at a short distance therefrom, the rotor carrying the hammers or beaters being associated in common with all of these mill segments.

The outlets provided according to the invention may be completely free or may possibly be covered selectively with screens having various hole sizes, so as to allow preselection of the size of the discharged product. Two or more such screens may be very simply arranged on a common slide which may be displaced so that the corresponding outlet is either kept completely free, or is selectively covered by one of the screens.

An embodiment of the invention will be described by way of example with reference to the drawings.

BRIEF DESCRIPTION OF THE DRAWINGS

FIG. 1 is a schematic front view of the hammer mill.

FIG. 2 is a plan view of this hammer mill.

FIG. 3 schematically shows two outlet screens.

FIG. 4 is a schematic front view of a feed proportioning apparatus for the material to undergo size reduction.

FIG. 5 is a schematic view of the bottom side of the proportioning apparatus according to FIG. 4.

DETAILED DESCRIPTION OF THE INVENTION

As may be seen from FIGS. 1 and 2, a rotor 3 driven by an electric motor 11 is supported on an essentially vertical axis 2 in a grinding chamber 1. The rotor 3 is here provided in a known manner not shown with hammers or beaters, the outer ends of which sweep over the circle of impact 3 indicated in dotted lines in FIG. 2.

In the arrangement shown here, three supply ducts 4 are provided at the periphery of the grinding chamber 1, which communicate via three corresponding inlets *7a* with the grinding chamber 1. The material to be ground delivered via the supply ducts 4 is therewith fed in radially downwards at the periphery of the grinding chamber 1. Each supply duct is provided with guide elements 10 which feed the coarse material radially in several horizontal planes to the grinding chamber 1 and the rotor 3. For this purpose, guide plates 10 are provided in each supply duct 4 in the arrangement shown in FIGS. 1 and 2. Other suitable guide means may also be used, which may for example be of adjustable height in order to radially feed the material to be ground in different planes into the grinding chamber 1. Each supply duct 4 is further associated at the periphery of the grinding chamber with a corresponding discharge duct 5, which is arranged at a short distance in the grinding direction, i.e. in the direction of rotation of the rotor 3, in each case behind the supply duct 4 along the grinding path. These discharge ducts communicate in each case with the grinding chamber 1 by means of an outlet *7b*.

The supply ducts 4 may be arranged in any other suitable manner to radially feed in the coarse material supplied from above at the periphery of the grinding chamber 1 into the corresponding mill segment.

The outlet *7b* of each discharge duct 5 may be selectively covered with a screen of a given hole size in order to adjust the size of the product of reduced size discharged from this outlet. Screens having different hole sizes are here advantageously arranged on a common slide 9 as is represented schematically by way of example in FIG. 3. The screens arranged on the slide 9 comprise in this case two screen areas 8*a* and 8*b* with different hole sizes and a free opening 8*c* arranged therebetween. When the slide 9 is vertically displaced with respect to the corresponding outlet 7*b* in the manner shown schematically in FIG. 1, the free opening 8*c* may thus be at the outlet 7*b*, or the screens 8*a* or 8*b* may be selectively inserted into this outlet 7*b*, when the size of the discharged product having undergone size reduction is to be preselected.

The described arrangement of the hammer mill shown in the drawing here comprises, by way of example and to simplify the drawing, three supply ducts 4 with three associated discharge ducts 5, which are alternately arranged and uniformly distributed over the periphery of the grinding chamber 1.

However, the number of supply and discharge ducts may be freely chosen as occasion demands and adapted in each case to the desired grinding operation.

The hammer mill according to the invention will in each case be subdivided into as great a number of mill segments or size reduction zones as possible, while the spacing between the supply ducts 4 and the discharge ducts 5 should be kept as short as possible, and may be practically nil.

Experiments have demonstrated that after feeding in coarse material via a supply duct 4, the size reduction is already substantially terminated after a grinding path of about 40 to 60 mm.

In one embodiment of the hammer mill, having a grinding chamber 1 with a diameter of 1500 mm, the discharge duct 5 associated with each supply duct 4 came behind it at a distance of only 50 mm, while the width of each inlet 7*a* was selected with an arc length of 100 mm and of each outlet 7*b* was selected with an arc length of 200 mm. Consequently, for each mill segment, comprising a supply duct 4 with an inlet 7*a*, an intermediate wall segment area 6 and an associated discharge duct 5 with an outlet 7*b*, only about 300 to 350 mm of the mill circumference is required.

With the selected dimensions, the hammer mill can thus be provided with sixteen supply ducts 4 and sixteen discharge ducts 5 at the periphery of the grinding chamber, and thus be subdivided into sixteen mill segments. As an illustration of the screen hole sizes on the outlet slide 9, 1.5 mm may be mentioned for the screen area 8*a* and 3 mm for the screen area 8*b*. Instead of the free opening 8*c*, a third screen may possibly be provided with a very large hole size of e.g. 20 mm or more.

In the shown hammer mill, the coarse material which is supplied from above and fed radially into the grinding chamber 1 via a supply duct 4 is impacted by the hammers or beaters of the rotor 3 passing by each inlet 7*a* and thereby substantially undergoes size reduction, after which it immediately arrives at the outlet 7*b* of the associated discharge duct 5. As the product obtained in a given segment has thus already substantially undegone size reduction, it can go nearly entirely through the free opening 8*c* or through a screen 8*a* or 8*b*, into the associated discharge duct 5, so that the product of reduced size may be discharged and need not be further carried along through the mill.

Due to the coarse material being delivered vertically and fed radially into the grinding chamber 1, the material is deflected by the rotor hammers or beaters by an angle of 90° into a horizontal path of movement, which further promotes size reduction.

The product of reduced size discharged from the hammer mill according to the invention via the discharge ducts 5 may be conveyed to any suitable screening arrangement, while recycling of screening residues for further size reduction may be desirable.

The relatively simple arrangement of the hammer mill according to the invention provides various advantages, of which the following may be cited: a substantial decrease of the power requirements for size reduction, lowered costs of wear and tear and reduced heating of the material as well as decreased humidity removal during size reduction.

The feed proportioning apparatus shown schematically in FIGS. 4 and 5 is particularly suitable for continuously feeding coarse material for size reduction to a hammer mill according to the invention with several supply ducts, each supply duct of the hammer mill being associated with a corresponding proportioning screw of a feed proportioning apparatus of the type shown in FIGS. 4 and 5.

The feed proportioning apparatus according to FIGS. 4 and 5 is symmetrically arranged about a vertical axis 20 and comprises two coaxial cells 21 and 22 for receiving two different types of material, several underlying proportioning screws 23 and corresponding inner and outer openings 24 and 25 in the bottom of the cells 21 and 22, which correspond to a first and a second inlet of the proportioning screws 23.

As may be seen particularly from FIG. 5, the proportioning screws 23 are arranged about the vertical axis 20 and respectively extend radially outwards from the openings 24 and 25 disposed below the cells 21 and 22 and from the corresponding first and second screw inlets up to their outlet tube 26.

The speed of rotation of the proportioning screws is controlled in a known manner by control means, not shown, as a function of the required loading of the hammer mill, so that the mill supplied with coarse materials for size reduction by the feed proportioning apparatus may be operated with a uniform charge.

The two cells 21 and 22 serve to receive different materials, of different grain sizes for example, which are successively picked up by the screws 23 via the openings 24 and 25 and continuously supplied to the mill.

A first material contained in the central cell 21 is picked up with priority by the proportioning screws 23, via the inner openings 24 and the corresponding first screw inlets and delivered to the mill, while a second material contained in the outer annular cell 22 is additionally taken up by the screws 23, via the outer openings 25 and the corresponding second screw inlets, in a sufficient amount to operate the mill with the desired charge.

One may for example connect the discharge ducts 5 of the hammer mill via a screening installation, not shown, with the central cell 21, while the outer annular cell 22 is supplied with fresh coarse material.

Thanks to the special operating mode of the described feed proportioning apparatus, the first material contained in the central cell 21 is ensured absolute priority with respect to the second material contained in the outer annular cell 22, since this first material in the central cell 21 is necessarily picked up first by the proportioning screws 23 via the first screw inlets corresponding to the inner openings 24 and the second material is only picked up subsequently from the outer annular cell 22 via the second screw inlets corresponding to the outer openings 25 and supplied to the hammer mill.

Thanks to such a mode of operation of the described proportioning apparatus, known problems which arise when milling different materials can be solved in a most simple manner with a minimum expenditure of energy and simple auxiliary technical means.

Such an arrangement of the feed proportioning apparatus is also possible with other controllable conveying devices, for example with chain conveyors, vibrating conveyors, etc., while maintaining the advantages explained above with regard to the automatically controlled priority in the dosage of various materials thanks to the very simple coaxial cell arrangement cooperating as described via corresponding openings with several radially arranged proportioning means.

The number of coaxial cells and associated proportioning devices may be selected more or less freely as required.

TECHNICAL APPLICABILITY

The hammer mill according to the invention as well as the feed proportioning apparatus may be utilized for various size reductions and loose materials. They are particularly well adapted for the preparation of mixed fodder, while cooperation between the hammer mill with several supply ducts and the feed proportioning apparatus offers special advantages for the continuous dosage of various materials by means of several proportioning devices.

I claim:

1. A hammer mill having a grinding chamber, a rotor with hammers or beaters, and means for feeding coarse material and discharging a product of reduced size, said grinding chamber being arranged substantially horizontally, said rotor being supported on a vertical axis, said means for feeding coarse material and discharging a product comprising a plurality of supply ducts with corresponding inlets for feeding said coarse material for size reduction and a plurality of discharge ducts with corresponding outlets for discharging said product of reduced size from said grinding chamber, said supply ducts and discharge ducts being arranged on the periphery of said grinding chamber in such manner that each supply duct with its inlet is associated with a corresponding discharge duct with an adjacent outlet, said outlets each being positioned between two inlets on the periphery of said grinding chamber, whereby said grinding chamber is subdivided peripherally into a corresponding number of mill segments each of which is defined by an inlet and a corresponding outlet.

2. The hammer mill claimed in claim 1 wherein said inlets and said corresponding adjacent outlets are regularly distributed around the periphery of said grinding chamber.

3. The hammer mill claimed in claim 1, wherein said outlets are associated with a plurality of interchangeable screens having different hole size which can be selectively placed in an operative position in said corresponding outlet.

4. The hammer mill claimed in claim 3, wherein said screens are each arranged on a slide associated with said corresponding outlet.

5. The hammer mill claimed in claim 1, wherein said supply ducts comprise guide means and are so arranged that said coarse material may be supplied to the periphery of said rotor in different horizontal planes.

6. A hammer mill according to claim 1, including a feed proportioning apparatus for continuously proportioning and supplying various loose materials in several streams at an adjustable feed rate for continuously feeding said supply ducts, said feed proportioning apparatus comprising at least two coaxial cells arranged on a vertical axis, the first of said cells being a central cell adapted to receive a first loose material, and at least one outer annular cell surrounding said first cell and adapted to receive a second loose material, and a plurality of feed proportioning devices having an adjustable feed rate and arranged radially beneath said cells, each proportioning device being in communication with said first cell through a first inlet of said proportioning device corresponding to an opening in the bottom of said first cell and being in communication with said outer annular cell through a second inlet of said proportioning device corresponding to an opening in the bottom of said outer annular cell, whereby said proportioning devices when in operation receive various loose materials from said cells via said first and second inlets and deliver said materials at the outer ends of said proportioning devices through outlet tubes so as to provide continuous feed of said materials to corresponding supply ducts of said hammer mill.

7. The hammer mill claimed in claim 6 wherein said feed proportioning devices comprise radially arranged proportioning screws having an adjustable speed of rotation.

* * * * *